US008194905B1

(12) United States Patent
Vinther, Sr.

(10) Patent No.: US 8,194,905 B1
(45) Date of Patent: Jun. 5, 2012

(54) COHERENT WAVE FULL SPECTRUM ACOUSTIC HORN

(76) Inventor: Gordon Alfred Vinther, Sr., Provincetown, MA (US)

( * ) Notice: Subject to any disclaimer, the term of this patent is extended or adjusted under 35 U.S.C. 154(b) by 1149 days.

(21) Appl. No.: 12/069,749

(22) Filed: Feb. 13, 2008

Related U.S. Application Data

(60) Provisional application No. 60/901,385, filed on Feb. 14, 2007.

(51) Int. Cl.
*H04R 1/02* (2006.01)
*H04R 1/20* (2006.01)
*H04R 25/00* (2006.01)

(52) U.S. Cl. ..... 381/342; 381/341; 381/181

(58) Field of Classification Search ..... 181/159; 381/341–343, 182
See application file for complete search history.

(56) References Cited

U.S. PATENT DOCUMENTS

| | | | | | |
|---|---|---|---|---|---|
| 1,477,554 | A | | 12/1923 | Grissinger | |
| 2,856,467 | A | * | 10/1958 | Hoodwin | 381/341 |
| 4,116,302 | A | | 9/1978 | Seebinger | |
| 4,138,594 | A | | 2/1979 | Klipsch | |
| 4,227,051 | A | * | 10/1980 | Thomas et al. | 381/342 |
| 4,283,606 | A | * | 8/1981 | Buck | 381/342 |
| 4,313,032 | A | | 1/1982 | Thomas et al. | |
| 4,619,342 | A | * | 10/1986 | Buck | 181/184 |
| 4,845,759 | A | | 7/1989 | Danley | |
| 4,853,964 | A | | 8/1989 | Weckler | |
| 5,046,581 | A | | 9/1991 | Mitchell | |
| 5,526,456 | A | * | 6/1996 | Heinz | 381/340 |
| 5,821,471 | A | | 10/1998 | McCuller | |
| 5,900,593 | A | * | 5/1999 | Adamson | 181/152 |
| 6,095,279 | A | * | 8/2000 | Adamson | 181/152 |
| 6,343,134 | B1 | | 1/2002 | Czerwinski | |
| 6,411,718 | B1 | | 6/2002 | Danley et al. | |
| 6,425,456 | B1 | | 7/2002 | George | |
| 6,628,796 | B2 | * | 9/2003 | Adamson | 381/342 |
| 7,218,749 | B1 | | 5/2007 | Noponen et al. | |
| 7,236,606 | B2 | * | 6/2007 | Werner | 381/342 |
| 7,252,176 | B2 | | 8/2007 | Moore | |
| 2002/0106097 | A1 | | 8/2002 | Danley et al. | |
| 2002/0150270 | A1 | * | 10/2002 | Werner | 381/342 |
| 2004/0005069 | A1 | * | 1/2004 | Buck | 381/336 |
| 2004/0238268 | A1 | | 12/2004 | Danley et al. | |

FOREIGN PATENT DOCUMENTS

| | | |
|---|---|---|
| GB | 303837 | 3/1930 |

* cited by examiner

*Primary Examiner* — Lincoln Donovan
*Assistant Examiner* — Alexander Talpalatskiy
(74) *Attorney, Agent, or Firm* — Robert W. Pitts

(57) ABSTRACT

A horn apparatus comprises a high frequency horn housed within a low frequency horn. High frequency and low frequency drivers are positioned side by side and are at substantially the same distance from a reflective surface. Sound emitted by both drivers strikes this same reflective at approximately the same position and the low frequency and high frequency sound is reflected at the same angle. The sound emitted by both drivers is thus time aligned and superposition of sound at the same frequencies from both drivers will not cancel out or cause significant interference and sound distortion.

20 Claims, 6 Drawing Sheets

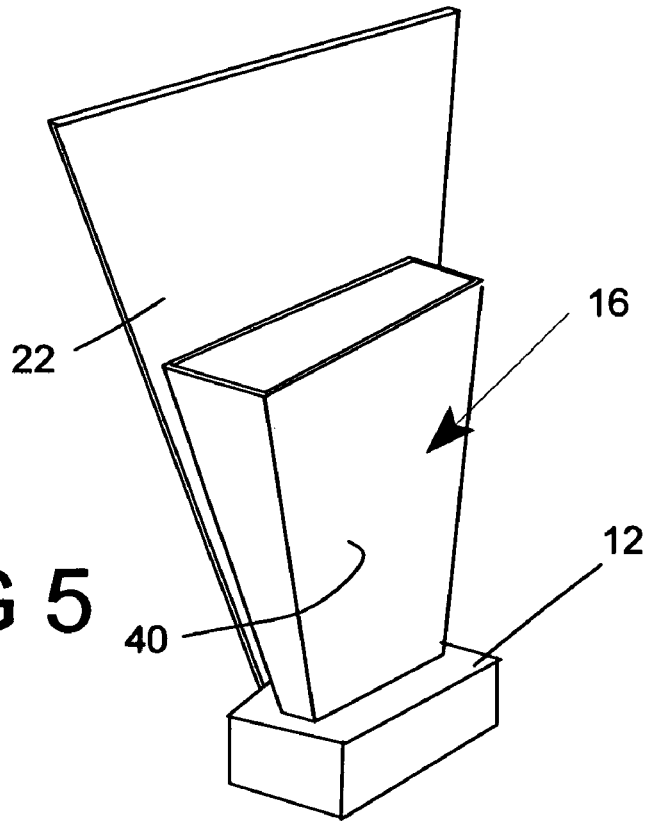
FIG 5
FIG 6
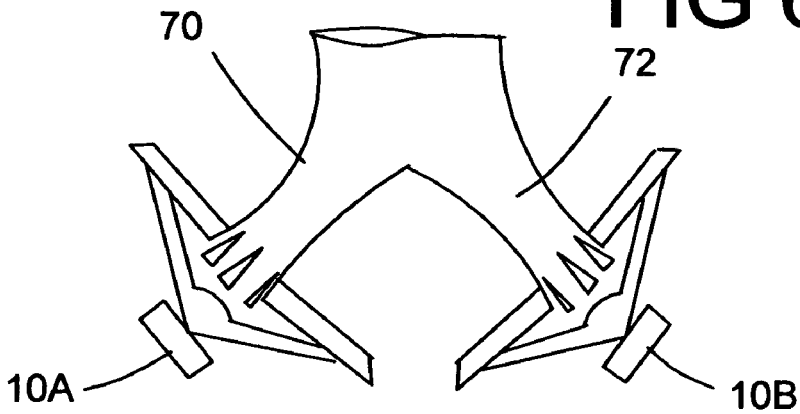

COHERENT WAVE FULL SPECTRUM ACOUSTIC HORN

CROSS REFERENCE TO PRIOR CO-PENDING APPLICATION

This application claims the benefit of the prior co-pending U.S. Provisional Patent Application 60/901,385 filed Feb. 14, 2007.

BACKGROUND OF THE INVENTION

1. Field of the Invention

The present invention is related to horn type loudspeakers employing high and low frequency drivers using a common horn to direct sound to the listener. This invention is also directed to an acoustic horn apparatus that can provide an improved full spectrum sound.

2. Description of the Prior Art

U.S. Pat. No. 5,526,456 identifies a number of goals for an acoustic horn or loudspeaker. These goals include use of as little power as possible and to provide a compact horn without unduly sacrificing sound reproduction characteristics. Sound should be directed to the listener with as little blocking and interference as possible. Horn loudspeakers should also be concentrated so that the sound is directed to the listener. In a loudspeaker or horn apparatus using multiple drivers, the sound waves emanating from the mouth of the speaker should also be in phase.

Prior art horn in horn loudspeakers have incorporated a high frequency horn within a low frequency horn to integrate their coverage. In some prior art devices the smaller high frequency horn creates an acoustic shadow and low frequency sound waves can be blocked. If the high frequency drivers are placed in front of the low frequency drivers in a prior art horn in horn apparatus, the sound leaving the speaker will be out of phase.

U.S. Pat. No. 5,526,456 employs a pair of high frequency drivers mounted to the side of the horn centerline and connected to the horn throat by a single coupling passage. Two low frequency drivers are located on opposite sides and are each also connected to the throat by coupling passages. A common virtual or apparent source is created for both high frequency and low frequency so that all sound appears to emanate from the same point. Another version includes only a single high frequency driver and a single low frequency driver. U.S. Pat. No. 6,343,134 discloses a number of other prior art loudspeaker systems, including some with multiple drivers in a single horn.

SUMMARY OF THE INVENTION

This invention is intended to provide a single coherent wave horn source capable of nearly full spectrum output. To accomplish this, the output from multiple sources follow substantially the same path through the horn apparatus and are time aligned and closely spaced about a common axis. While low frequencies are not directionally controllable, high frequencies are readily manipulated and can be directed to a reflector whose shape determines the dispersion of these frequencies. In multi-source loudspeaker systems, and particularly in large venue applications, it is desirable that the sound coverage does not vary through the crossover region.

Two sources, each covering a portion of the audio spectrum are provided. One source is a high frequency driver projected through a high frequency horn positioned within a low frequency horn. The other source is a low frequency driver projecting through the common low frequency horn. The axes of the sources are directed to a reflector at the rear of the low frequency horn. By directing the axes rearward the mouth of the low frequency to horn can be larger than that provided by a vertical projection for improved low frequency performance. The sources are further aligned such that the centers of the drivers are equidistant from the reflector thus allowing a flat acoustic sum in the crossover region.

BRIEF DESCRIPTION OF THE FIGURES

FIG. 5 is a three dimensional view of a high frequency horn subcomponent.

FIG. 6 is a view showing the relative position of two low frequency acoustic drivers.

DETAILED DESCRIPTION OF THE PREFERRED EMBODIMENTS

Figure 1:
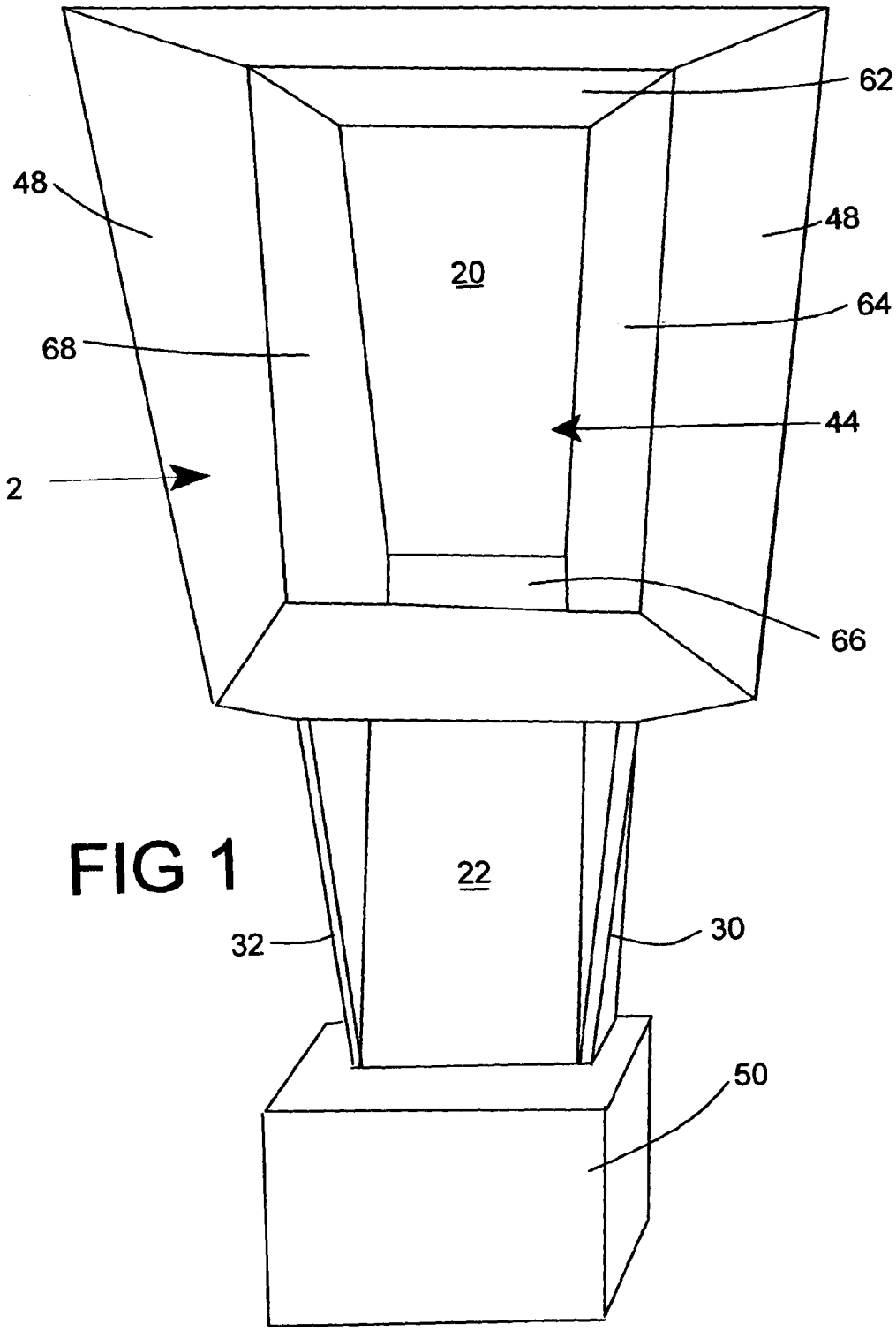
FIG. 1 is a front view of the horn.
Figure 2:
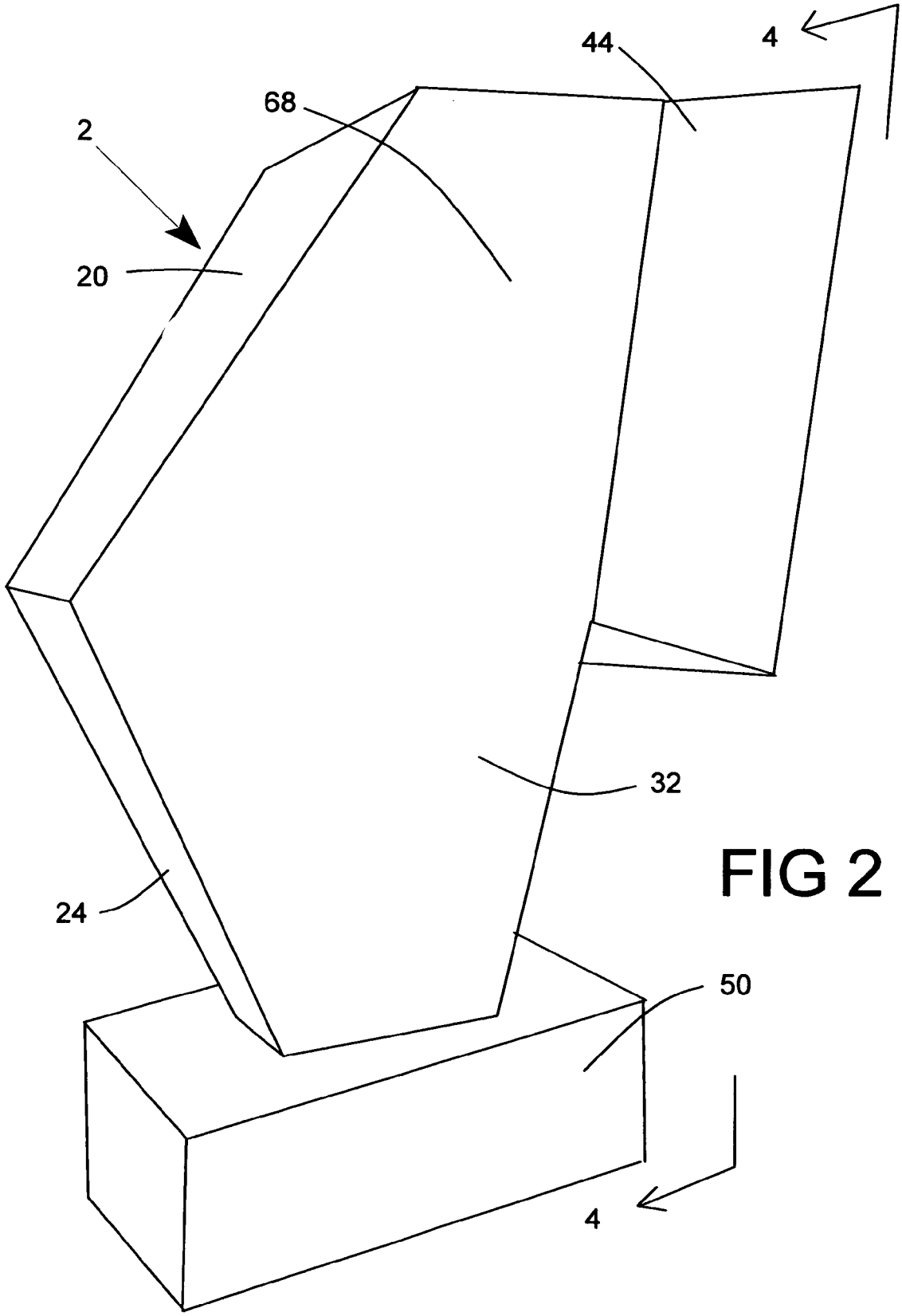
FIG. 2 is a three dimensional view of the horn showing one side and the rear of the horn.

The full spectrum acoustic horn apparatus 2, comprising the preferred embodiment of this invention, includes a low frequency source or driver 10 and a high frequency source or driver 12 positioned generally side by side. The acoustic output of the low frequency horn 14 and high frequency horn 16 can thus be so close that the sound emitted by the horn apparatus 2 will be such that the two points from which sound is emitted from each driver will appear to be located at the same point.

A low frequency horn 10 is formed by the exterior walls 22, 24, 30 and 32 of the horn apparatus 2, and a high frequency horn 16 extends from the high frequency driver 12. The high frequency horn 16 is located within the low frequency horn 14. The high frequency horn 16 is formed between three walls 22, 30 and 32 forming a part of the low frequency horn 14 and an interior wall 40 that diverges from the first or front exterior wall 22 thus forming the remainder of the high frequency horn 12. This interior wall 40 will extend between two opposite side walls 30, 32 of the low frequency horn 14.

The low frequency driver 10 and the high frequency driver 12 are located at the base 50 of the full spectrum horn apparatus 2, and the sound emanating from both low and high frequency drivers or sources 10, 12 will initially be directed upward. Both the high frequency sound waves and the low frequency sound waves will project upward from the drivers and through the lower stages of the high frequency horn and the low frequency horns respectively and strike a reflector 20. The reflector 20 forms a portion of the upper back wall 24 of the low frequency horn 14, and this reflector or reflective surface 20 extends at an angle relative to the vertical. Both high frequency sound and low frequency sound strike this reflector surface 20 and are redirected through the mouth 44 of the horn apparatus 2. The angle of the reflector 20 is chosen to project sound horizontally with reference to FIG. 4. Of course the angle of incidence will be equal to the angle of reflection. Sound will then exit the mouth 44 horizontally and will enter the surroundings and be directed toward the intended location of the listeners or at least the primary listeners. By redirecting the sound from the vertical to the horizontal, the footprint of the horn apparatus 2 can be reduced and the sound can be directed toward the normal position of the listener or listeners.

In the preferred embodiment of this invention, the high frequency horn driver 12 comprises an air motion transformer, although other high frequency drivers can be employed. In the preferred embodiment, only a single high frequency driver is employed, but it should be understood that the high frequency driver can comprise more than one high frequency source manifolded to the high frequency horn. In the preferred embodiment, the high frequency driver 12 will emit frequencies of between 200 hertz and 20,000 hertz of substantially constant amplitude. There will be a fall off at the lower range of frequencies emanating from the high frequency driver 12, between approximately 200 hertz and 1000 hertz.

Figure 4:
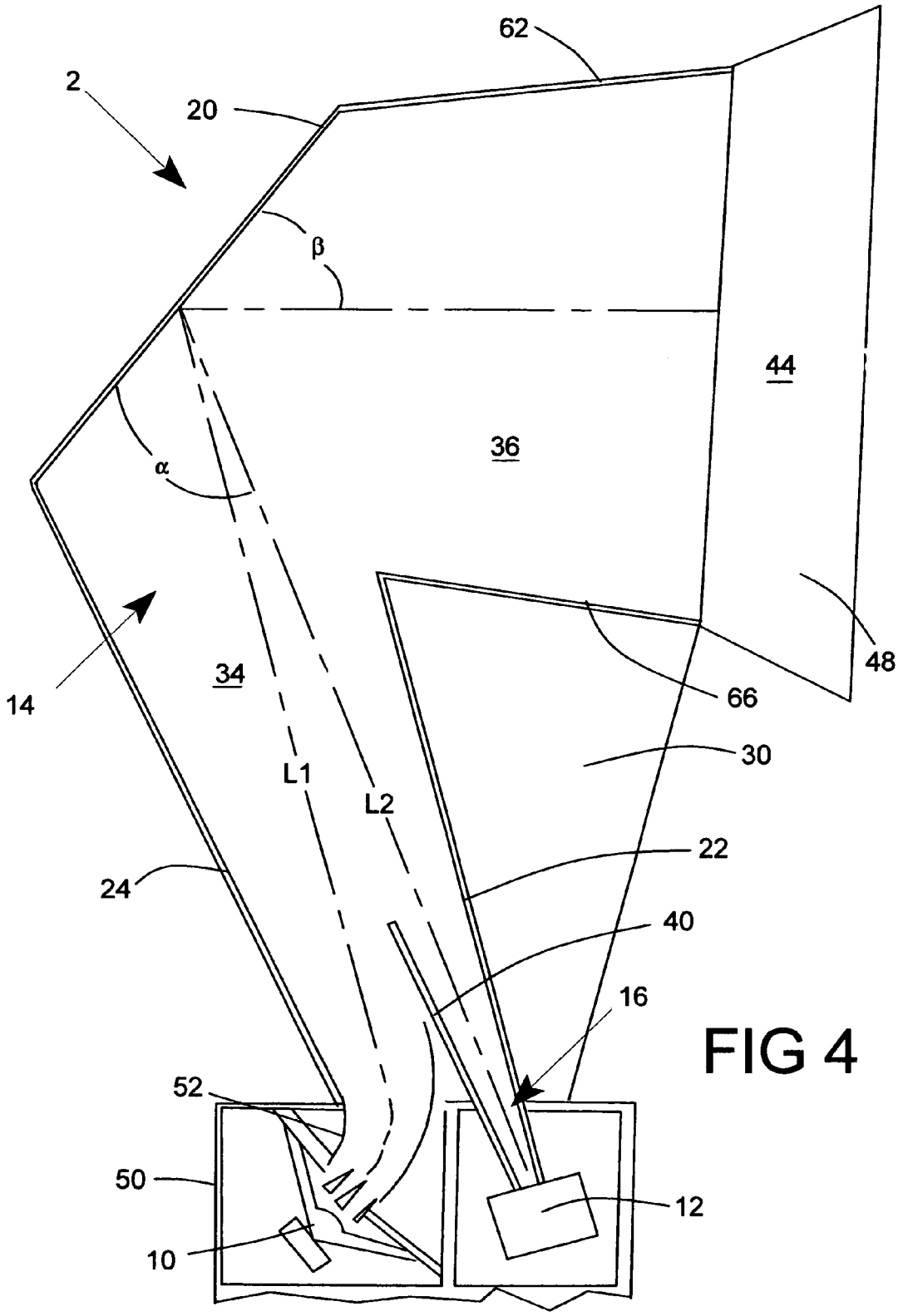
FIG. 4 is a sectional view of the horn taken along section lines 4-4 in FIG. 2.

As shown in the section view of FIG. 4, the high frequency driver 12 is centered relative to the axis L2 projecting through the center of the high frequency horn 16. The axis L2 of the high frequency horn 16, comprising the centerline of the sound waves in the high frequency horn, is incident upon the reflector 20 at an angle of incidence $\alpha$. Axis L2 will then form an angle of incidence $\alpha$ equal to the angle of reflection $\beta$ relative to the horizontal as shown in FIG. 4. Sound will thus be projected horizontally through the mouth 44. One side of the high frequency horn 16 is formed by a first or front flat exterior wall 22, which also comprises a wall of the low frequency horn 10. A second wall opposite the first flat wall is an interior wall 40 that is shorter than the first flat exterior wall 22. Both the first flat wall 22 and the interior wall 40 abut opposite end or side walls 30, 32, and in the preferred embodiment, these four flat wall, which diverge relative to each other form flat sides of the high frequency horn 16.

The high frequency horn 14 is a complete high frequency radiator and can have a mouth circumference at least equal to the wavelength of the lowest design frequency of interest. For instance, the circumference of the high frequency horn could be equal to the thirty three (33) inches, the wavelength of a four hundred (400) hertz signal.

The low frequency horn 14 is also defined by a series of flat walls 22, 24, 30, 32. The first flat wall 22, which defines one side of the high frequency horn 16, also comprises an exterior wall forming the lower portion 34 of the low frequency horn 14. Three other walls in combination with the first flat wall define the lower portion of the diverging low frequency horn 14. A second flat wall 24 defines the rear wall of the low frequency horn 14, and the second flat wall is on the opposite side from the first flat wall 22, which will form the front wall of the low frequency horn 14.

The axis L1 of the low frequency horn 14, comprising the centerline of the low frequency horn 14, is incident upon the reflector 20 at an angle of incidence approximately equal to the angle $\alpha$ at which the axis L2 of the high frequency horn 16 is incident upon the reflector 20. Ideally the angle of incidence of the low frequency waves would be equal to the angle of incidence of the high frequency waves, and since both the low frequency driver 10 and the high frequency driver 12 are remote from the reflector 20, the incidence angles will be approximately the same. The angle of incidence of the high frequency sound is more important than the angle of incidence of the relatively lower frequency sound.

The reflector 20 comprises a flat portion of the upper section of the exterior of the low frequency horn 14 and the horn apparatus 2. This reflector 20 extends transversely relative to the high frequency horn 16 and the low frequency horn 14 so that the sound waves propagated through each of the horns strike the reflector 20. Since the angle of reflection $\beta$ is equal to the angle of incidence $\alpha$, both the relatively high frequency sound wave and the relatively high frequency sound waves will be reflected in the same direction. As shown in FIG. 4 the centerlines of the sound waves propagating through the lower portion 34 of both the low frequency horn 14 and the high frequency horn 16 will be incident upon substantially the same point on the reflective surface 20. In the preferred embodiment of this invention the axis L2 of the high frequency horn 16, and thus high frequency sound will strike the center of the reflector 20.

Figure 3:
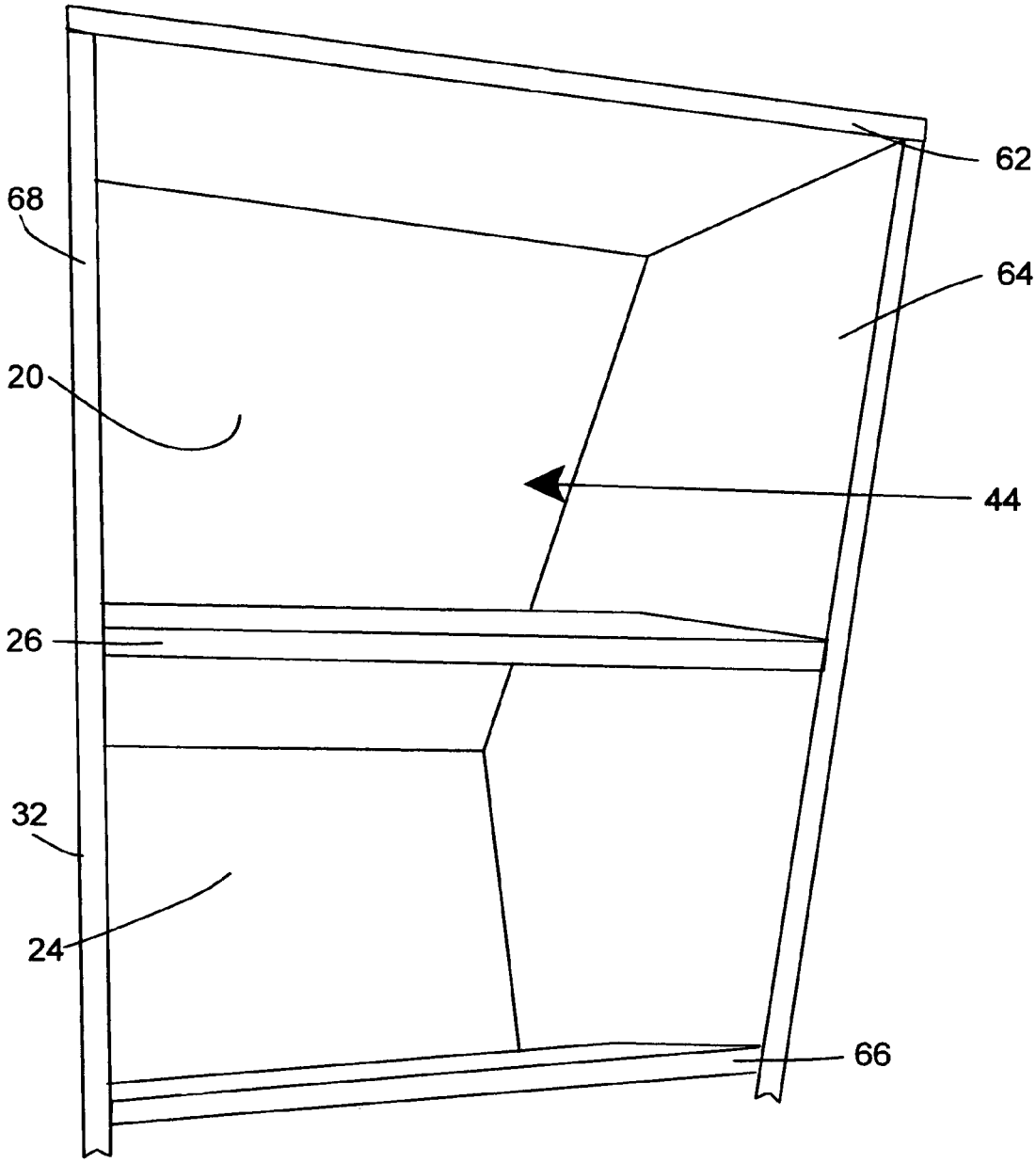
FIG. 3 is a three dimensional view of the mouth of the horn apparatus.

The upper portion 36 of the horn apparatus extends horizontally and is also formed by four diverging walls 62, 64, 66, 68, and comprises a continuation of the lower portion 34 of the horn apparatus 2. When the horn apparatus 2 is positioned as shown in FIG. 4, the acoustic waves will exit the mouth 44 horizontally. This will not only direct the sound toward the listener or listeners, it will also reduce the height of the horn apparatus 2. FIG. 3 shows the mouth 44 with the peripheral doors 48 removed. Doors 48 are shown in FIGS. 1 and 4. These doors 48 can be attached to the walls 62, 64, 66 and 68 and will form and extension of the upper portion 34 of the horn apparatus 2. Doors 48 can be detachable to improve portability of the horn apparatus 2. A stiffening panel or brace 26 is located between the mouth 44 and the reflecting wall 20. This stiffening panel 26 can be employed to reduce vibration in the relatively large sidewalls 64 and 68. Since the sound waves, after reflection, will travel substantially horizontally, they will travel generally parallel to the stiffening panel 26, and little interference will result. It should be understood that stiffening panel can be optional and will not be needed in all versions of the horn apparatus 2.

In the preferred embodiment of this invention two low frequency drivers 10A and 10B are employed. These two low frequency drivers 10A and 10B are positioned side by side and project at an angle relative to the low frequency horn 14. A curved manifold 52 is located between the low frequency drivers 10A and 10B and the lower portion of the flared low frequency horn 14. In the preferred embodiment of the invention the low frequency drivers will emit sound in the range of frequencies of between approximately 40 hertz to 1000 hertz. It should be understood that a single low frequency driver 10 can also be employed.

There will be an overlap of the sound emitted by the high frequency driver 12 and the relatively low frequency drivers 10 in the range of between 200 hertz and 1000 hertz in the preferred embodiment of this invention. In this crossover region, the sound waves are additive, significant distortion will occur if the sound waves emitted from the high frequency driver 12 and the low frequency drivers 10 are not substantially in phase To reduce distortion due to waves that are not in phase, the path length between the high frequency driver 12 and the reflector 20 is equal to the path length between low frequency drivers 10 and the reflector 20. With reference to FIG. 4, L1 is equal to L2. Since the drivers 10, 12 are positioned side by side, these path lengths can be chosen so that they will be equal. The curved portion of the path length in the low frequency horn 10 in manifold 52 will be part of the low frequency path L1. Since the path lengths will be the same, the sound waves traveling through the two horns will be time aligned, and it will appear that the high frequency driver 12 and the low frequency drivers 10 are located at the same point. In addition to keeping the waves from the two sources in phase, this path length equivalence will insure a flat amplitude response for the frequencies in the cross over region between 200 and 1000 hertz. Both amplitude and phase are important in this cross over region. The sums of the acoustic outputs of this horn apparatus 2 will be flat in the cross over region.

Figure 7:
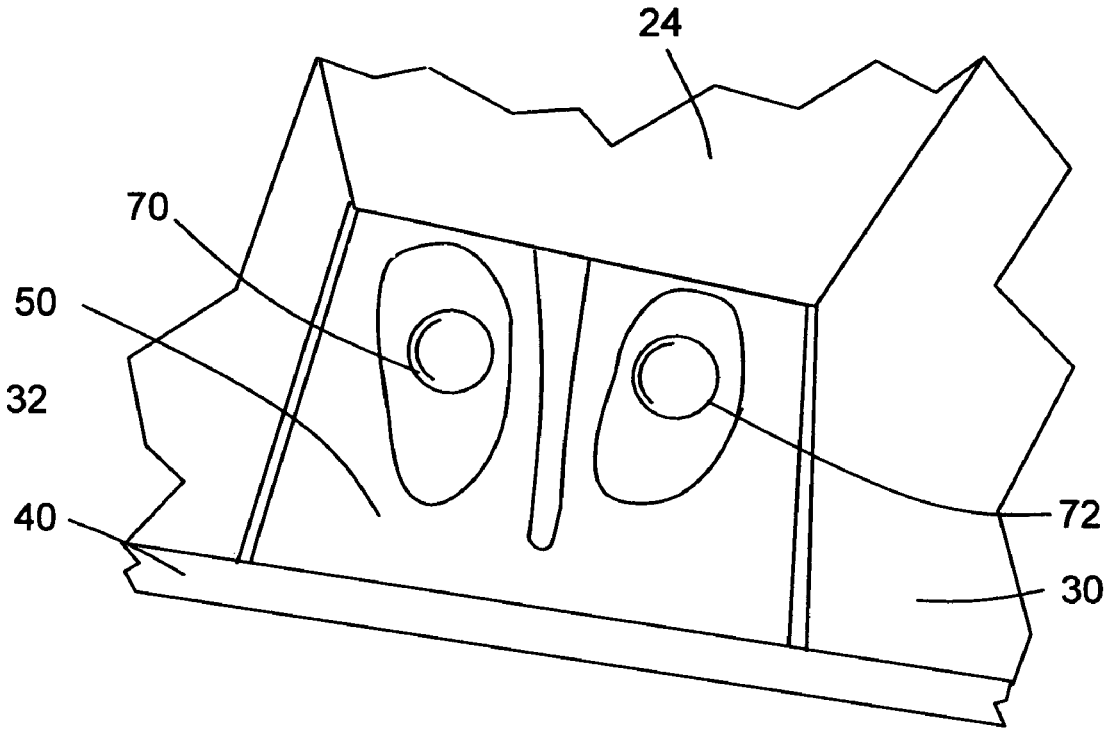
FIG. 7 is an interior view of the lower portion of the horn apparatus showing the interior of the low frequency horn.

In the preferred embodiment two identical low frequency drivers 10A and 10B are employed to form the low frequency source 10. As seen in FIGS. 6 and 7, manifolds 70 and 72 extend from the two low frequency drivers 10A and 10B and enter the low frequency horn 14, and each low frequency driver 10A and 10B will be the same distance from the reflector 20.

In the preferred embodiment, the components of the horn apparatus 2 can be formed using a series of flat panels. The cost of the horn apparatus 2 can thus be reduced and the construction simplified. Individual panels can be attached to each other in such a way that both the low frequency horn 14 and the high frequency horn 16 will experience constantly expanding transmission paths. FIG. 5 shows that the high frequency horn 16 can be fabricated as a separate subcomponent and then assembled within the low frequency horn 14, since the wall 22 will form a part of both the low frequency horn 14 and the high frequency horn 16.

The flat panels forming horn apparatus 2 can be fabricated from material that is relatively lightweight. For example, the panels forming the horns can be formed from a material consisting of a corrugated core embedded within a veneer that will either confine or reflect sound waves of the frequencies with which horn apparatus 2 would normally be employed. Alternatively one or more of the panels could be fabricated from a foam material. The horn apparatus of the preferred embodiment is approximately 6.5 feet in height, 2.5 feet wide and 3.5 feet deep. The size of this horn apparatus makes is especially desirable that lightweight materials be used and that the configuration of the horn will be suitable for construction using relatively lightweight materials.

This horn apparatus 2 will also occupy a relatively small footprint for a horn that provides the sound quality and the expansion that this horn is capable of. Footprint means the horizontal surface area occupied by the horn apparatus 2. The reflection of the sound waves as provided by this invention reduces the footprint without degrading the sound quality.

The performance that has been demonstrated with a horn of this configuration results in a flat acoustic response of plus or minus one (1) db from 100 to 15,000 hertz when subjected to pink noise.

The preferred embodiment of this invention is primarily intended for use in interior spaces and will, provide high quality sound. The horn apparatus 2 would normally be mounted on the floor in such applications, but it should be understood that the horn apparatus 2, or alternate versions of this invention could be suspended from the roof, especially in those instances when the horn apparatus is used in a larger facility, such as an auditorium, a theater, a concert hall, a church or in similar facility. Although the horn apparatus 2 would normally be positioned to emit sound waves in a generally horizontal direction at a height of a normal listener, it should be understood that the horn apparatus can be tilted to direct sound as desired. Multiple horns of this type can also be employed together to produce high quality sound throughout a facility. It should be understood that the preferred embodiment depicted herein is merely a representative example of an apparatus employing this invention, and alternate versions of this invention would be apparent to those of ordinary skill the art. For example, the horns could be formed by some curved or faceted surfaces and not entirely of flat panels. The embodiment depicted herein does not therefore constitute the only embodiment that would be defined by the following claims, which determine the scope of the invention

I claim:

1. An acoustic apparatus wherein a high frequency horn is placed within a low frequency horn with high and low frequency acoustic drivers equidistant from a common reflector facing the relatively low frequency driver and the relatively high frequency driver.

2. The acoustic apparatus of claim 1 comprising a time aligned acoustic apparatus.

3. The acoustic apparatus of claim 1 wherein high and low frequency sounds reflected from the common reflector facing the relatively low frequency driver and the relatively high frequency driver simultaneously exit through a common mouth.

4. The acoustic apparatus of claim 3 wherein the high frequency horn comprises a fully radiating high frequency horn formed within the low frequency horn, which comprises an exterior horn with the common reflector forming a part of the low frequency horn.

5. A full spectrum acoustic horn apparatus comprising:

a relatively high frequency acoustic driver;

a relatively low frequency acoustic driver positioned adjacent the relatively high frequency acoustic driver;

a high frequency horn disposed relative to the relatively high frequency acoustic driver;

a low frequency horn disposed relative to the relatively low frequency acoustic driver, the high frequency horn being positioned within the low frequency horn;

a reflective surface on the low frequency horn aligned so that sound from the high frequency horn is incident upon a central location on the reflective surface and is reflected through an opening in the low frequency horn.

6. The full spectrum acoustic horn apparatus of claim 5 comprising a coherent wave full spectrum acoustic horn.

7. The full spectrum acoustic horn apparatus of claim 5 wherein a path length between the relatively high frequency acoustic driver and the reflective surface is equal to a path length between the relatively low frequency acoustic driver and the reflective surface, so that waves from the relatively low frequency and relative high frequency acoustic drivers are time aligned.

8. The full spectrum acoustic horn apparatus of claim 5 wherein centers of the relatively high frequency and relatively low frequency drivers both emit sound in a crossover frequency region and the relatively high frequency driver and the relatively low frequency driver are equidistant from the reflector to produce a flat acoustic sum in the crossover frequency region.

9. The full spectrum acoustic horn apparatus of claim 5 wherein sound is emitted horizontally.

10. The full spectrum acoustic horn apparatus of claim 5 wherein the high frequency horn is defined in part by a first exterior wall diverging from an interior wall, and the low frequency horn is defined in part by the first exterior wall and a second exterior wall diverging from the first exterior wall.

11. The full spectrum acoustic horn apparatus of claim 10 wherein the interior wall is shorter than the first and second exterior walls.

12. The full spectrum acoustic horn apparatus of claim 10 wherein the reflective surface is on the same side as the second exterior wall.

13. The full spectrum acoustic horn apparatus of claim 12 wherein the reflective surface is opposed to the first exterior wall.

14. The full spectrum acoustic horn apparatus of claim 5 wherein the low frequency horn is formed by a series of flat panels on opposite sides thereof, the flat panels on each side of the low frequency horn extending transversely relative to adjacent flat panels.

15. The full spectrum acoustic horn apparatus of claim 5 wherein the circumference of the mouth of the high frequency horn is equal to the wavelength of a 400 hertz signal.

16. The full spectrum acoustic horn apparatus of claim 5 wherein the relatively high frequency source and the relatively low frequency source are arranged to be coincident relative to the reflective surface.

17. The full spectrum acoustic horn apparatus of claim 5 wherein the high frequency horn is disposed relative to the relatively high frequency source to permit full expansion of sound emitted by the relatively high frequency acoustic driver.

18. An acoustic horn comprising:

a relatively low frequency driver emitting a relatively low frequency sound;

a relatively high frequency driver emitting a relatively high frequency sound;

a high frequency horn allowing full expansion of the relatively high frequency sound;

a low frequency horn, the high frequency horn being positioned within the low frequency horn;

a reflective surface spaced from the relatively low frequency driver and the relatively high frequency driver and facing the relatively low frequency driver and the relatively high frequency driver, both the relatively low frequency sound and the relatively high frequency sound being incident upon the same reflective surface and reflected by the single reflective surface through a mouth of the horn.

19. The acoustic horn of claim 18 wherein the relatively low frequency driver and the relatively high frequency are positioned in time aligned relationship relative to the reflective surface.

20. The acoustic horn of claim 18 wherein the reflective surface is flat.

* * * * *